US005788200A

United States Patent [19]

Jones

[11] Patent Number: 5,788,200

[45] Date of Patent: Aug. 4, 1998

[54] HIDDEN SHELF SUPPORT BRACKET

[76] Inventor: C. Reid Jones, P.O. Box 455, Taylorsville, Ky. 40071

[21] Appl. No.: 687,208

[22] Filed: Jul. 25, 1996

[51] Int. Cl.[6] ..... A47F 5/08

[52] U.S. Cl. ..... 248/235; 248/249; 248/239; 411/400

[58] Field of Search ..... 248/235, 239, 248/217.4, 243, 249, 216.1, 250; 403/403, 280, 283, 405.1; 411/400, 401, 107, 340; 211/90.1

[56] References Cited

U.S. PATENT DOCUMENTS

| | | | |
|---|---|---|---|
| 365,690 | 6/1887 | Kochsmeier | 248/249 |
| 381,389 | 4/1888 | Kocksmeier | 248/249 |
| 668,128 | 2/1901 | Jessup | 248/249 |
| 704,154 | 7/1902 | Walker | 248/249 |
| 1,633,438 | 6/1927 | De Pew | 248/249 X |
| 2,909,352 | 10/1959 | Van Buren | 248/239 |
| 3,219,302 | 11/1965 | Smith | 248/248 X |
| 3,273,844 | 9/1966 | Hodson | 248/217 |
| 3,945,595 | 3/1976 | Schlueter | 248/239 |
| 4,441,433 | 4/1984 | Caldwell | 248/222.51 X |
| 5,326,061 | 7/1994 | Hamilton | 248/239 |

*Primary Examiner*—James R. Brittain
*Assistant Examiner*—Robert J. Sandy

[57] ABSTRACT

A one piece, completely concealed when installed shelf support bracket (11) cylindrical in structure accommodating threads (1) as a means of securing to shelf materials (9) while communicating along its length to straight members (2)-(4)-(6)-(8) and bends (3)-(5)-(7) to facilitate easy installation and removal of shelves mounted horizontally to vertical walls.

1 Claim, 1 Drawing Sheet

HIDDEN SHELF SUPPORT BRACKET

BACKGROUND—FIELD OF INVENTION

This invention relates to shelves, specifically to brackets that support shelves.

BACKGROUND—DESCRIPTION OF PRIOR ART

Brackets for securing shelves horizontally to a wall are well known in the prior art. Conventional shelf brackets or mounting means typically incorporate the plurality of fasteners and support hardware or brackets to secure the shelf to the wall and supports to hold the shelf in a horizontal plane perpendicular to the wall. No conventional shelf bracket or mounting means has been available that is of one piece construction requiring no additional fasteners or under supports for horizontal positioning and once mounted is completely concealed.

Inventors have created brackets and supports that are of one piece construction. U.S. Pat. No. 3,273,844 to Hodson (1966) discloses a bracket of one piece construction, however its design is primarily for use as a hanger type support and is restrictive in the area of wall material thickness and composition.

U.S. Pat. No. 3,945,595 to Schlueter (1975) discloses shelf support members of one piece construction that are external supports also restrictive in the area of wall composition and thickness. Their primary finction and design is related to the appliance industry.

Likewise U.S. Pat. No. 2,909,352 to Van Buren (1959) discloses a shelf support constructed of molded plastic incorporating a sheet metal spring member intended to transfer the shelf load to the mounting wall. However it is also an externally exposed device with no method of securing a shelf horizontally and perpendicular to a wall surface. To support a shelf in a horizontal position, these devices must be used in plurality on adjacent wall surfaces.

U.S. Pat. No. 5,326,061 to Hamilton (1994) discloses a shelf mounting means that is of one piece construction and is concealed when mounted. The disclosed shelf mounting means requires precise location and adjustment of additional fasteners and requires an under support to maintain a shelf in a horizontal position. Additionally its use would require a precision recess or groove machined into the shelf material.

OBJECTS AND ADVANTAGES

Several objects and advantages of the present invention are as follows:

(a) To provide a shelf support bracket of inexpensive one piece construction;

(b) To provide a shelf support bracket that once mounted is totally concealed;

(c) To provide a shelf support bracket that requires no additional securing devices such as fasteners or adhesives;

(d) To provide a shelf support bracket that requires no additional under supports of the shelf material to remain in a horizontal position perpendicular to the wall surface;

(e) To provide a shelf support bracket that can be used to mount shelves to a multitude of wall surface materials such as but not limited to drywall, sheetrock, plywood, paneling, lathe and plaster and plaster board;

(f) To provide a shelf support bracket that can be used to mount shelves to a multitude of wall thickness';

(g) To provide a shelf support bracket that is easily adjustable to the variations described in (e) and (f);

(h) To provide a shelf support bracket that requires no special design tools to mount shelves;

(i) To provide a shelf support bracket that can be used on a multitude of shelf material such as but not limited to plastics, wood and composition materials;

(j) To provide a shelf support bracket that requires only simple and easy machining (a small securing hole) to the materials mentioned in (i); and (k) To provide a shelf support bracket that is easily adjustable for maintaining shelves perpendicularly under various loading conditions;

Further objects and advantages are to provide a shelf support bracket that allows a shelf to be mounted to a wall surface then easily removed or relocated with minimal damage to the wall surface easily repairable to original condition with readily available material. Still further, objects and advantages will become apparent from a consideration of the ensuing descriptions and drawings.

DRAWING FIGURES

REFERENCE NUMBERALS IN DRAWINGS

| | |
|---|---|
| 1 Threads | 7 Bend for vertical |
| 2 Horizontal straight | 8 Vertical straight |
| 3 Bend from horizontal | 9 Shelf material |
| 4 Straight from bend | 10 Wall material |
| 5 Return bend | 11 Entire Shelf Support Bracket |
| 6 Straight for return | |

DESCRIPTION—FIGS. 1 TO 3

Figure 1:
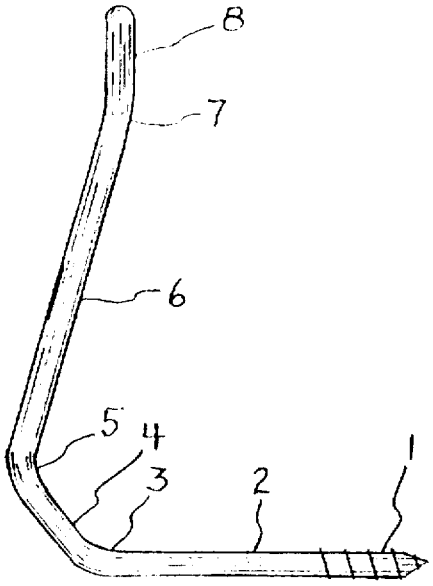
FIG. 1 shows a side view of the shelf support bracket.
Figure 2:
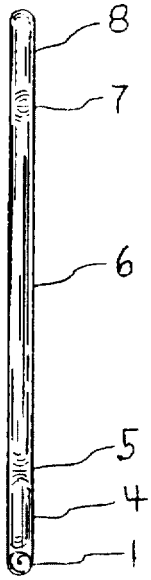
FIG. 2 shows a front view of the shelf support bracket.
Figure 3:
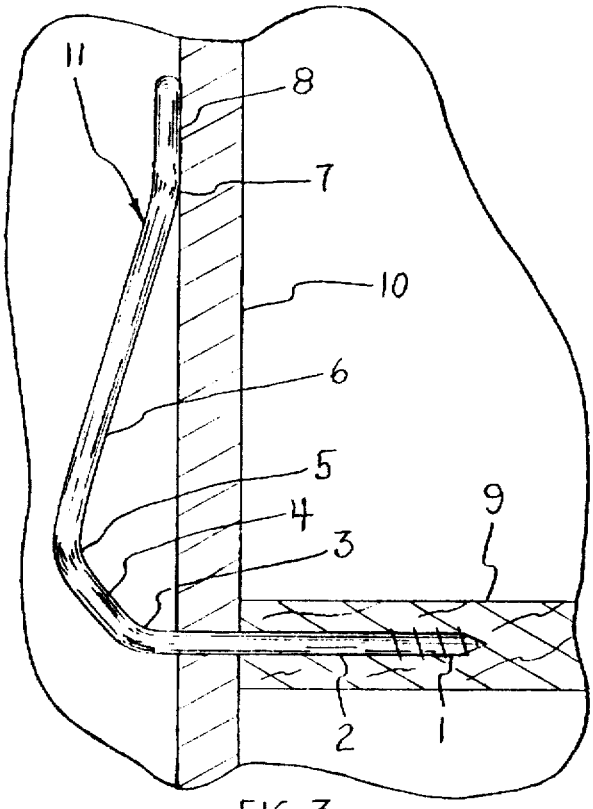
FIG. 3 shows a side view of the shelf support bracket secured to the shelf material and installed and mounted to the vertical wall material.

A typical embodiment of the shelf support bracket of the present invention is illustrated in FIGS. 1 through 3. The bracket can be manufactured from round steel wire. The steel can be cut to a predetermined length.

At one end of the steel wire are threads 1 of sufficient length and depth to be adequate for securing the shelf support bracket into drilled holes in the shelf material .

Beyond and on the same plane as the threads 1 is a horizontal straight 2 of sufficient length to adequately extend into the shelf material 9 and completely through and beyond the inner surface of wall material 10.

The horizontal straight 2 is followed by a bend from horizontal 3 accomplished by a suitable bending device. The bend from horizontal 3 is such a distance to be equal to or slightly less than one half the accomplishment of a perpendicular to the horizontal plane of the threads 1 and horizontal straight 2.

The distance of straight from bend 4 is of sufficient length to accomplish a straight through situation in conventional wall material 10.

A return bend 5 follows straight from bend 4 and is accomplished by a suitable bending device. The return bend 5 is such a distance to cause straight for return 6 to contact the interior (wall cavity side) of the wall material 10 at such a point that allows a small portion of horizontal straight 2 to protrude through and slightly beyond the interior side of conventional wall material 10 as illustrated in FIG. 3.

Consideration for the length of straight for return 6 being slightly less than the distance across the cavity section of conventional wall construction.

Straight for return 6 is followed by bend for vertical 7 and is accomplished by a suitable bending device. Bend for vertical 7 is such a distance to cause vertical straight 8 to be perpendicular to the threads 1 and horizontal straight 2.

Vertical straight 8 is such a length that a straight line measurement from the center of return bend 5 and termination of vertical straight 8 does not exceed the sum of the distance across the interior cavity section of conventional wall construction plus the thickness of the thinnest of conventional wall material 10.

From the description above a number of advantages of this Hidden Shelf Support Bracket become evident.

(a) The shelf support bracket can be easily and inexpensively manufactured from readily available stock materials;

(b) The shelf support bracket is easy to secure to the intended shelf material requiring only drilled holes to secure its threads into;

(c) The shelf support bracket easily allows the shelf to be mounted to a variety of wall surface materials requiring only small hole penetration through the wall material;

(d) The shelf support bracket requires no fastening to the wall supporting structure allowing for easy removal;

(e) The shelf support bracket supports the shelf material and its intended load by distributing the load forces;
  (1) Against the face of the wall material
  (2) Against the interior opposing face of the wall material
  (3) Downward against a full cross sectional penetration of the wall material (f) The shelf support bracket can be manufactured from different diameters of material to increase or decrease its load bearing capacity; and (g) By use in plurality the shelf support brackets can mount shelf material in a length restricted only by the ofthe intended mounting wall.

OPERATION—FIGS. 3 TO 6

The manner of using the Hidden Shelf Support Bracket is described in the following disclosure.

A plurality of shelf support brackets are required to properly support a shelf. The quantity used is determined by the intended length of the proposed shelf.

First drilled holes should be installed into the intended shelf material (preferably wood or plastic). The diameter of the holes should be slightly less than the diameter of the shelf support brackets. The distance between centers of the drilled holes should be greater than a straight line distance measured from bend from horizontal 3 and the termination of vertical straight 8. The depth of the drilled holes should be a distance not less than the distance measured from the beginning of threads 1 to a point on horizontal straight 2 at which a perpendicular line would touch vertical straight 8.

Next, matching holes should be drilled or suitably installed into the intended vertical wall surface. The holes should be perpendicular to the wall material 10 and the diameter of the holes should be slightly greater than the diameter of the shelf support bracket. Any structural wall surface supports should be avoided. The distance between centers of the wall surface holes should be equal to the distance between centers of the holes drilled into the shelf material 9.

Figure 6:
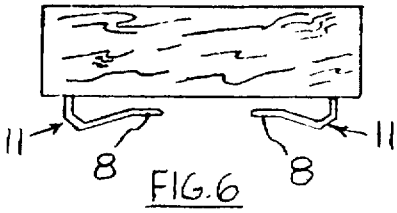
FIG. 6 shows one of the installation procedures.

The shelf support brackets 11 should now be secured to the shelf material 9. This is accomplished by turning threads 1 in a clockwise manner into drilled holes in shelf material 9. Shelf support brackets 11 should be screwed into shelf material 9 until the distance from the shelf material 9 and vertical straight 8 when aligned parallel with one another is equal to the thickness of the wall material 10 as shown in FIG. 6. Once this distance is attained, the shelf support brackets 11 should be turned clockwise until they are perpendicular with the intended top surface of the shelf material 9.

Figure 4:
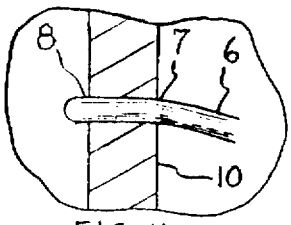
FIG. 4 shows one of the installation positions.
Figure 5:
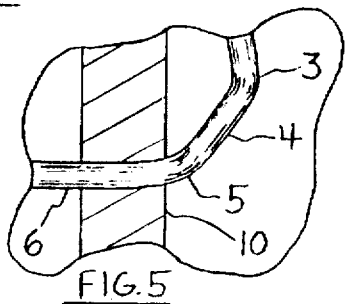
FIG. 5 shows one of the installation positions.

To install the shelf with attached shelf support brackets into and upon the vertical wall surface see FIGS. 3–4–5–6. While holding the shelf material 9 in a vertical position parallel with the wall material 10 insert the vertical straights 8 into the mating drilled holes in the wall material 10 as shown in FIG. 4. While applying inward pressure on the shelf support brackets 11 raise entire assembly so that horizontal straights 2 align perpendicular with the wall material 10 and continue inward pressure until return bends 5 contact the wall material 10.

The final installation procedure is performed by applying inward horizontal pressure on the shelf support brackets 11 while applying downward vertical pressure on the shelf material 9. Pull the shelf material 9 into a downward arc causing the flat edge surface of the shelf material 9 to rest against the wall material 10 while vertical straights 8 reside against the inner surface of the wall material 10 as illustrated in FIG. 3.

SUMMARY OF THE INVENTION

Thus, the reader will see that the hidden shelf support of the invention provides a highly versatile, simple, inexpensive, aesthetically pleasing, yet adequate means of mounting a horizontal shelf perpendicular to a multitude of wall surfaces.

While the above description contains many specificity's, these should not be construed as limitations on the scope of the invention, but rather as an exemplification of one preferred embodiment thereof. For example the shelf support brackets could be manufactured of plastic by injection molding process for specific shelf materials or sizes.

Accordingly the scope of the invention should be determined not by the embodiment(s) illustrated, but by the appended claims and their legal equivalents.

I claim:

1. A one piece shelf support bracket independent of additional hardware comprising:

a) a cylindrical body, one end of the body having threads for engagement with a shelf material;

b) a first straight portion extending beyond and in axial alignment with said threads;

c) said first straight portion terminating axial alignment for a first directional change bend creating an obtuse angle;

d) a second straight portion extending beyond said first directional change bend to facilitate passage of directional changes through an aperture in a wall surface;

e) said second straight portion terminating for a second directional change bend creating an acute angle from the plane of said threads and said first straight portion;

f) a third straight portion extending beyond said second directional change bend for engagement with the inner wall surface;

g) said third straight portion terminating for a third directional change bend creating a forth straight portion perpendicular to said threads and said first straight portion;

h) and said forth straight portion continuing a distance for engagement with said inner wall surface on a parallel plane.

* * * * *